US007273011B2

(12) United States Patent
Bissig

(10) Patent No.: US 7,273,011 B2
(45) Date of Patent: Sep. 25, 2007

(54) STRUCTURE OF A PROJECTILE

(75) Inventor: Josef Bissig, Altdorf (CH)

(73) Assignee: Saab Bofors Dynamics Switzerland Ltd, Thun (CH)

( * ) Notice: Subject to any disclaimer, the term of this patent is extended or adjusted under 35 U.S.C. 154(b) by 0 days.

(21) Appl. No.: 11/432,460

(22) Filed: May 11, 2006

(65) Prior Publication Data

US 2007/0051268 A1 Mar. 8, 2007

Related U.S. Application Data

(63) Continuation of application No. PCT/CH2004/000663, filed on Nov. 3, 2004.

(51) Int. Cl.
*F42B 12/18* (2006.01)

(52) U.S. Cl. ..... 102/476; 102/308

(58) Field of Classification Search ..... 102/476, 102/308, 473, 478, 499, 272, 273
See application file for complete search history.

(56) References Cited

U.S. PATENT DOCUMENTS 5,003,883 A 4/1991 Mixon et al.
5,353,709 A * 10/1994 Emmenegger et al. ..... 102/309
5,415,105 A * 5/1995 Voss et al. ..... 102/476
5,750,917 A * 5/1998 Seckler et al. ..... 102/476
5,952,604 A * 9/1999 Helander ..... 102/476

FOREIGN PATENT DOCUMENTS

EP 0 497 394 A1 8/1992
EP 0 928 948 A1 7/1999
WO WO 2005/045357 A1 * 5/2005

* cited by examiner

*Primary Examiner*—James S. Bergin
(74) *Attorney, Agent, or Firm*—Schweitzer Cornman Gross & Bondell LLP

(57) ABSTRACT

A projectile casing is designed to insure proper operation of the charges located therein. The charges are spaced by spacer tubes constructed such that the tubes are dispersed radially after the detonation of the preliminary charge without adversely affecting the effect of the following main charge by shock waves and/or vibrations. Solid shock barriers and damping members are provided in addition to a thin-walled projectile casing. Such a construction has proved successful, in particular, for tandem hollow charges, and also for use against active armour plating.

11 Claims, 3 Drawing Sheets

STRUCTURE OF A PROJECTILE

The present application is a continuation of application PCT/CH2004/000663, filed Nov. 3, 2004.

The present invention relates to a structure of a projectile capable of sustaining large impact shocks and maintaining proper detonation characteristics at a target.

BACKGROUND OF THE INVENTION

High shock energy occurs in projectiles with hollow charges and multiple warheads during and after the impact at the target, and this shock energy can disrupt the effective charge, reduce its power and even prevent it from working.

It is generally known inter alia that in so-called tandem hollow charges both the shock of impact and the detonation of the preliminary charge can prevent the formation of a high-energy jet.

An electronic delay circuit for the delayed detonation of the main charge in a tandem hollow charge is known from EP-A1-0 497 394. A projectile with a percussion fuse at the front with a preliminary charge arranged behind it is provided in a first cylindrical region of the projectile. A second hollow charge is arranged in a substantially cylindrical region on the projectile's longitudinal axis by way of a single, tapered spacer tube. An electronic detonation device, which contains the delay circuit, is situated behind the main charge. The energy supply of the circuit arrangement and the necessary detonation voltage are implemented by a piezo crystal in the rear of the projectile. The impact shock of the elongate percussion fuse, which acts as a "stand off" means for the detonation of the preliminary charge at the correct time, is at the same time concentrated into the rear of the projectile by way of the projectile casing and can compress, i.e. activate, the piezo crystal located in that region.

Another tandem hollow charge with a casing in the form of a jacket consisting of a composite material (US-A-5,003,883) has a shield between the preliminary charge and the main charge, the shield keeping the explosive pressure of the preliminary charge away from the main charge and preventing the premature detonation thereof as a consequence of the pressure wave. To this end the main charge is covered by a lightweight fibre/epoxy dome. A central opening is closed by an aluminium plug which absorbs and deflects the central explosive pressure of the preliminary charge. As soon as the jet of the main charge is formed, the plug flies out of its bore and clears the path to the target for the jet.

Whereas EP-A1-0 497 394 discloses a solution for the safe and time-delayed activation of the main charge, US-A-5,003,883 provides a projectile with a low overall weight and a main charge protected from the explosive pressure of the preliminary charge.

In a rocket-propelled projectile with a plurality of charges to be detonated in succession, EP-A1-928 948 discloses a mechanical damper element interposed between two charges. To this end the two projectile bodies are screwed together, in which case a central cavity in which a leaf spring is inserted is formed between disc-like contact surfaces of the two parts.

A drawback with this design is that it is not possible for very high shock loading to be intercepted, since the shock of the impact is transmitted by way of the casing structure, mainly by way of the projectile casing. In addition, on account of their mass and inertia, embedded leaf springs cannot damp high-frequency vibrations and behave like rigid masses, so that the damping effect is restricted to low-frequency vibrations. In this way, it is only possible only for charges in projectiles which travel relatively slowly to be protected from impermissible shock loading.

The object of the present invention is therefore to provide a shock-absorbing structure which is also suitable for highly accelerated projectiles with charges arranged in succession and detonated with a time delay. In this way, the safety of the system is increased and, in particular, a premature activation of the main charge can be prevented.

The disruptions occurring at the target are to be minimized; in this case, influences from active armour plating (e.g. explosive reactive armour—ERA) upon the effective power of the projectile should likewise be reduced.

BRIEF DESCRIPTION OF THE INVENTION

The foregoing and other objects are attained by a projectile of the present invention having a jacket casing and first and second charges located in cylindrical regions separated by spacer tubes. The second charge has a larger calibre or diameter than the first charge, and the spacer tubes are outwardly tapered from the smaller to the larger diameter. The tubes may be joined by annular flanges.

The charges are generally hollow charges and thus form a tandem hollow charge. Other shaped charges and combinations thereof are also possible, however, such as for example a forward projectile charge and a rear conventional charge (in accordance with EP-B1-0 955 517 inter alia). In the same way, multiple warheads can be implemented in accordance with the same basic principle.

The invention is based on a recognition that a projectile casing can be thin-walled in the region of its forward (first) charge if solid structures are provided which deflect the impact of the gas of the first charge. The spacer tube is likewise thin-walled and, on account of a continuous increase in its diameter, prevents a direct transmission of the impact shock to the center of the second charge. The high internal pressure occurring at the target can burst the spacer tube, the individual fragments flying away in the radial direction without obstructing the second charge.

The second charge has a caliber which is larger by at least a factor of 2 than the first charge; the diameter of the spacer tube also increases accordingly. The length of the spacer tube, i.e. the distance between the two charges, amounts to at least twice the second caliber.

The annular flanges act as shock barriers and reduce the mechanical stressing of the detonation systems and the charges.

Acceleration measurements on projectiles with tandem hollow charges, which have a structure designed in accordance with the features of the invention, display relatively low G-values 9·81 $ms^{-2}$ at the location of the main charge. Vibrations which are particularly disrupting to the effective flow are likewise minimal. This is demonstrated in the case of fired projectiles by the high boring power of the jet of the hollow charge achieved at the target.

The use of a metallic dome in conjunction with a second flange is a highly space-saving construction and absorbs in an ideal manner the impact pulse for activating the detonation device. The shock waves occurring during the impact and the detonation of the preliminary charge can be diverted onto the casing jacket by a metallic dome mounted on a damping ring.

Positioning the dome on the forward side of the flange on absorbing material advantageously increases the free path length of the pusher formed by a rear hollow charge. Directly positioning the dome on the flange may reduce the free path length, but increases the shock wave deflection effect. A lateral mounting of the damping material in a resilient ring reduces the transmission of vibrations to the following structure.

The covering of the second charge may be provided with an adapter ring with a screw fastening, which has been found to be particularly effective, since it intercepts part of the shock wave.

Use of a damping ring or material of an organic material with embedded occlusions increases the shock absorption and reduces the transmission of vibrations to the sensitive second charge. Damping materials and, in particular, damping rings of an easily deformable material for example, commercially available aluminium foam, have also proved successful. A material of a plastics material which is provided with embedded microballoons, as described in CH-A5-674077, however, is particularly advantageous. Materials of this type are commercially available today and are used for deflecting detonation waves in shaped charges. Materials based on wood (cellulose) which act in a similar manner are likewise known and may be employed.

Incorporating thickened flange portions and discontinuities can result in velocity components in the radial direction during the detonation of the preliminary charge on the accelerated mass parts (fragments of the flange). This prevents collisions with following parts and with the jet of the main charge. At the same time the annular flange serves to dam the preliminary charge.

BRIEF DESCRIPTION OF THE DRAWINGS

Illustrative embodiments of the invention are set forth in the following detailed description and are illustrated in the drawings, wherein.

DETAILED DESCRIPTION OF THE INVENTION

Figure 1:
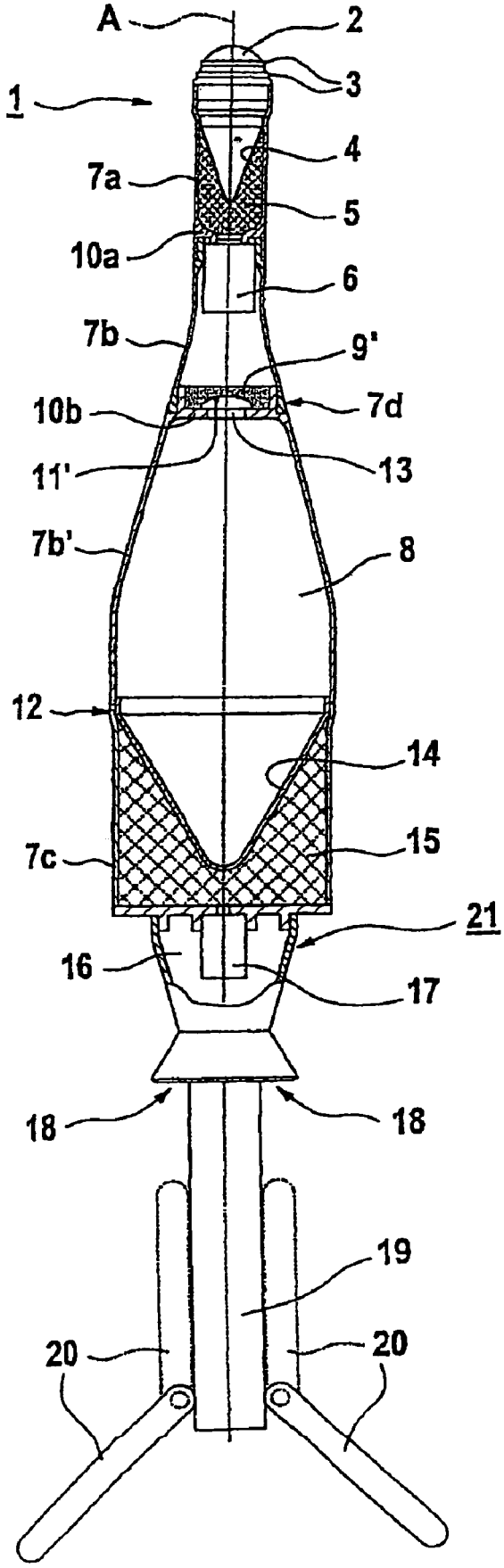
FIG. 1 is a cross-sectional view of a self-propelling projectile in accordance with the invention with a tandem hollow charge.

A self-propelled projectile with a tandem hollow charge as shown in FIG. 1 is designed in an axially symmetrical manner with respect to an axis designated A. A head 1 has a tip 2 with embedded resilient rings 3 and has good aerodynamic properties on account of its slender shape. A first hollow charge, comprising a covering 4 and a high-power explosive charge 5, is arranged in a set back orientation with respect to the actual impact part, the tip 2. The tip and hollow charge form a preliminary charge and are arranged in a cylindrical region 7*a* which is bounded at the rear by a flange ring 10*a*. A stand-alone detonating device 6, which projects into spacer tube part 7*b*, is inserted in the flange ring 10*a*. Part 7*b* is connected to a further part 7*b*' of the spacer tube at joint location 7*d*. The front of part 7*b*' has a flange ring 10*b* with an open passage 13 which is covered by a supporting dome 11'; with damping material 9' above it, secured by adhesion. Below the ring is a relatively large cavity 8 which can absorb possible impact of the gas generated by the preliminary charge 4, 5 and which transmits its kinetic energy in the form of deformation and fracture energy to the spacer tube 7*b*, 7*b*'.

A further joint location 12 connects the spacer tube 7*b*' in an overlapping manner to a further cylindrical region 7*c* of the projectile casing 7*a* to 7*c*, in which the main charge 14, 15 with its covering 14 and explosive 15 are situated. The hollow charge 14, 15 is supported on a rear part 21 which contains a further stand-alone fuse system 17 in an adapter 16 and from which the driving nozzles 18 of a solid-fuel drive 19 known per se project. Foldable vanes of a steering gear 20 may be seen at the rear end.

Figure 2:
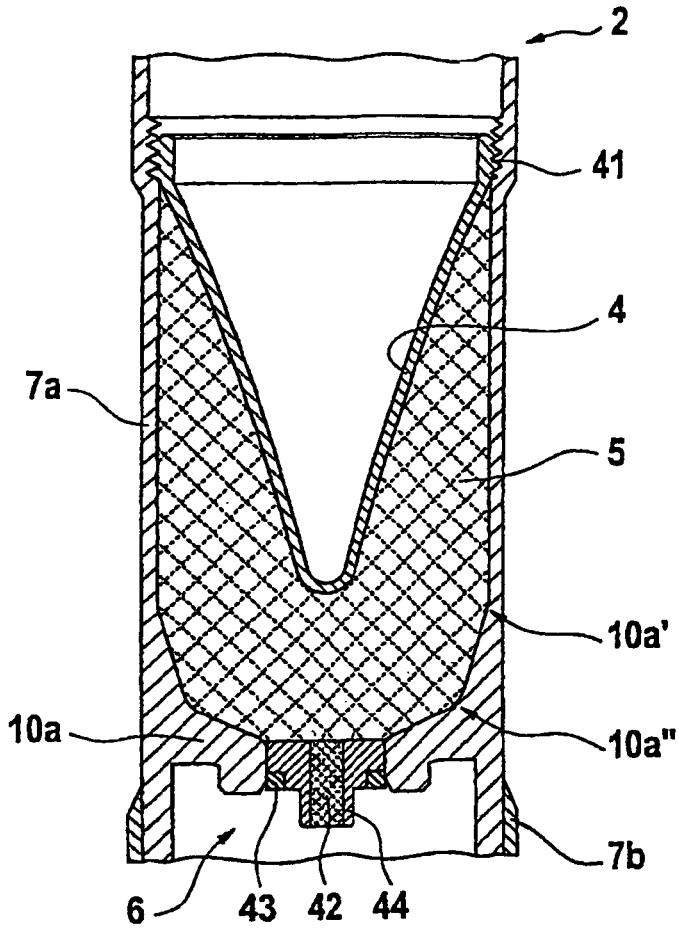
FIG. 2 is an enlarged cross-sectional view of the preliminary charge as shown in FIG. 1 with a front shock barrier.

In the enlarged sectional illustration of FIG. 2 the screw-in location for the tip 2 may be seen indicated above the cylindrical region of the projectile casing 7*a*. The covering 4 terminates in a screw thread fastening 41. The explosive 5 rests with positive locking against the solid flange ring 10*a* which is formed in one piece with the part 7*a*. In addition, a detonation booster 42 is inserted centrally in a centering pin 44, which in turn receives a damping ring 43 against which the fuse system 6 (not shown here) rests. The cylindrical part 7*a* terminates in the cavity of the spacer tube 7*b* in an appropriately adapted manner. The casing part 7*a* thickens and flares inwardly to form the flange ring 10*a*, commencing at point 10*a*' with a discontinuity at point 10*a*", assisting in the generation of radial velocity components on the flange fragments upon preliminary charge detonation, clearing them from the main charge jet, while the increased mass resulting from the forward thickening dams the preliminary charge.

Figure 3:
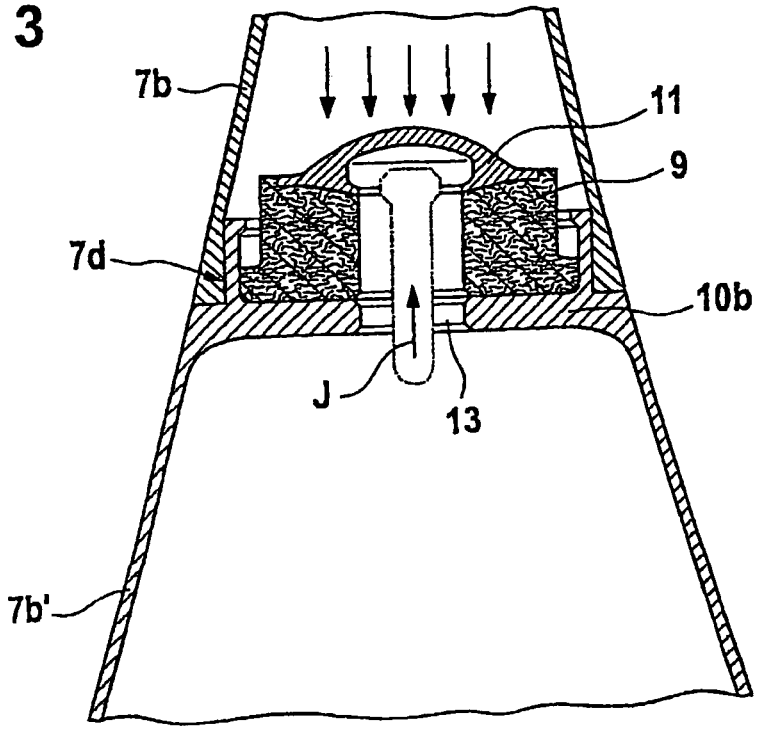
FIG. 3 is a sectional view of an arrangement and the operation of a rear shock barrier.

The illustration of FIG. 3 shows the lower shock barrier which projects into the interior space of the spacer tube 7*b*. In this case it may be clearly seen that at the joint location 7*d* is a projecting ring of the lower part 7*b*' and that the part 7*b* is supported about the ring. The damping ring 9 and, inserted therein the dome 11, are secured by adhesion upon a likewise solid flange ring 10*b*.

FIG. 3 shows, indicated symbolically by arrows, the front of a shock wave which is diverted by the dome 11. In this way, the pusher J of a jet of the hollow charge can be formed without disruption in the interior of the bore 13.

Figure 4:
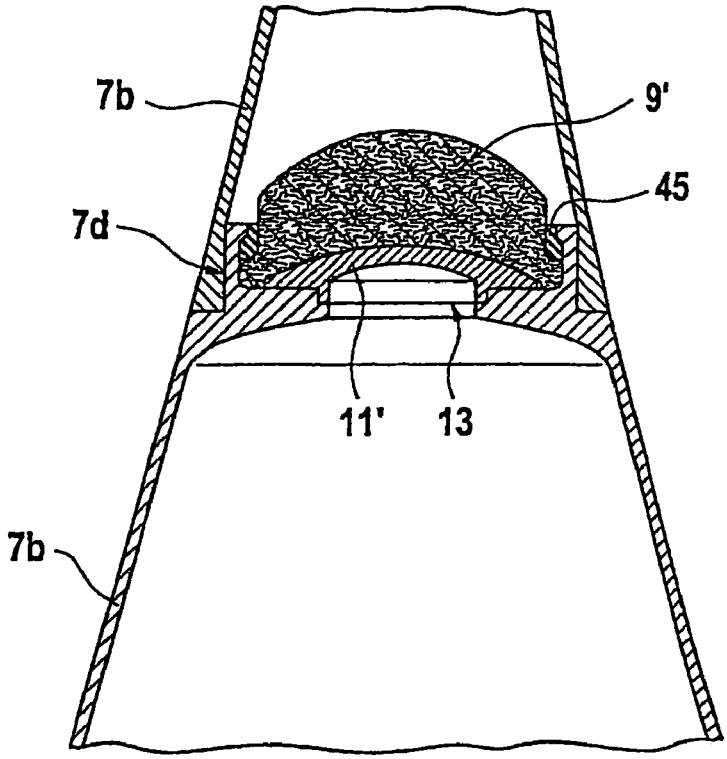
FIG. 4 is a sectional view of an alternative arrangement of a further shock barrier.

A similar solution may be seen in FIG. 4. In this case the shock wave first strikes damping material 9' that covers a supporting dome 11' centered in the bore 13. In addition, the damping material 9' is mounted at its edge in a soft damping ring 45.

Figure 5:
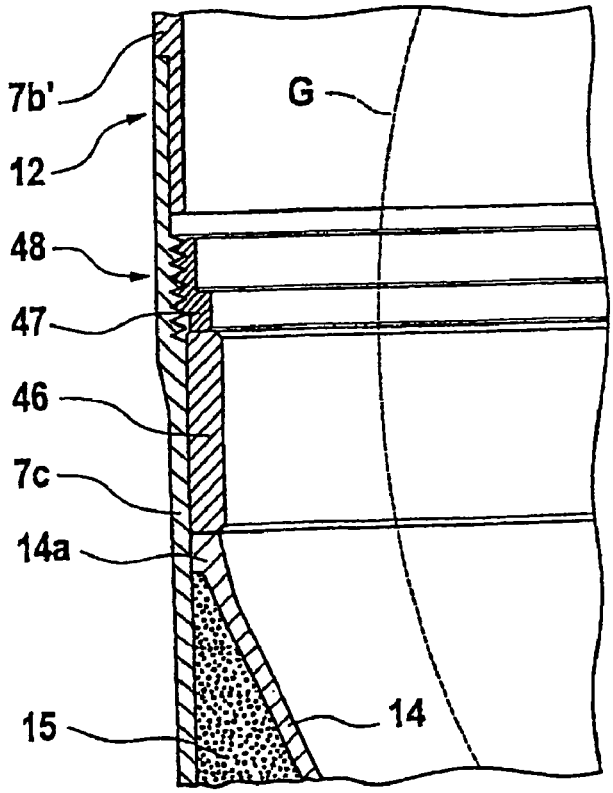
FIG. 5 is a partial sectional view depicting the mounting of the main charge as shown in FIG. 1 in the projectile casing.

Details on the composition of the main charge may be seen in FIG. 5. The spacer tube 7*b*' is inserted into the cylindrical projectile casing 7*c* and forms a joint location 12. The covering 14 rests with positive locking against the shaped charge 15 and, at its greatest diameter, has an adapter ring 14*a* which is loaded by a damping sleeve 46 and a threaded sleeve 47. The threaded sleeve 47 is screwed into an internal thread 48 of the cylindrical projectile casing 7*c*.

An envelope curve G is shown, which characterizes the sensitive range of the hollow charge substantially free of disruptions.

A projectile casing consisting of a commercially available aluminium alloy has proved successful. Such a material can easily be treated mechanically and displays inherent damping characteristics which proves advantageous, in particular, as resulting in a reduction in the vibrations transmitted to the charges as compared with other metallic materials. The joint locations are shrunk or drawn and secured by adhesion in a manner known per se.

The typical cruising speed of the projectile is immediately below 300 m/s. In the embodiment the calibre of the preliminary charge is 32 mm; that of the main charge is 112 mm. Commercially available "Impact shock, Piezo Fuze Systems" (PEPZ-05, Zaugg Elektronik AG, CH-4573 Lohn-Ammannsegg) with delay times capable of being set for the preliminary charge of <25 μs and for the main charge of approximately 370 μs have been found to be advantageous as fuse systems.

I claim:

1. A projectile with a projectile casing in the form of a jacket, comprising:

a first charge activated at a target by a detonation device responding to an impact with the target;

a second charge on a central longitudinal projectile axis A having a calibre greater than a calibre of the first charge capable of being activated with a defined time delay, the first charge being arranged in a first cylindrical region and the second charge being arranged in a second cylindrical region and spaced from the first charge by way of first and second spacer tubes, the spacer tubes increasing in diameters in a constant manner over their length to a diameter of the second region;

a first shock barrier comprising a first annular flange having a thickness greater than a thickness of the casing extending at a right angle to the axis A and located between the first charge and a forward part of the first spacer tube;

damping means positioned between the first and second charges; and a second shock barrier comprising a further annular flange in a forward part of the second spacer tube, the spacer tubes being connected to each other by way of a joint, the first flange being formed as a unitary construction with the first spacer tube, the second flange being formed as a unitary construction with the second spacer tube.

2. A projectile according to claim 1, characterized in that a detonation booster, which is attached to a piezo fuse system, is inserted in the first flange.

3. A projectile according to claim 1, characterized in that the damping means comprise a metallic dome positioned on the forward side of the second flange.

4. A projectile according to claim 3, characterized in that the metallic dome is mounted on a damping ring.

5. A projectile according to claim 3 wherein the dome also comprises a portion of the second shock barrier.

6. A projectile according to claim 1, characterized in that the damping means comprise a metallic dome positioned directly on the forward side of the second flange, the dome supporting damping material.

7. A projectile according to claim 6, characterized in that the damping material is held by a damping ring.

8. A projectile according to claim 1, characterized in that the first charge has a covering inserted into the projectile casing by way of a screw fastening.

9. A projectile according to claim 1, characterized in that the second charge has a covering provided with an adapter ring, a threaded sleeve for the adapter ring being inserted into the projectile casing by way of a damping sleeve.

10. A projectile according to claim 1, characterized in that the damping means comprise an organic material with embedded occlusions mounted to a metallic dome positioned on the forward side of the second flange.

11. A projectile according to claim 1, characterized in that at least one of the annular flanges has thickened portions of material at a front with a discontinuous inclination.

* * * * *